US005448217A

United States Patent [19]

Luetzow

[11] Patent Number: 5,448,217

[45] Date of Patent: Sep. 5, 1995

[54] IGNITION COIL WITH SPIRAL-BACK PYRAMID WINDINGS

[75] Inventor: Robert H. Luetzow, Huntington, Ind.

[73] Assignee: Kearney National, Inc., White Plains, N.Y.

[21] Appl. No.: 122,395

[22] Filed: Sep. 16, 1993

[51] Int. Cl.[6] ..... H01F 27/32

[52] U.S. Cl. ..... 336/227; 336/225; 336/206; 336/196

[58] Field of Search ..... 336/196, 208, 206, 227, 336/225, 220, 222, 228, 234, 214

[56] References Cited

U.S. PATENT DOCUMENTS

| | | | |
|---|---|---|---|
| 2,813,255 | 11/1957 | Williams et al. . | |
| 3,071,845 | 1/1963 | Leonard et al. . | |
| 3,546,580 | 12/1970 | Williams . | |
| 3,815,069 | 6/1974 | Palazzetti et al. | 336/200 |
| 4,654,563 | 3/1987 | Boyd | 336/234 X |
| 4,677,960 | 7/1987 | Ward | 123/598 |
| 4,794,361 | 12/1988 | Young | 336/189 |
| 5,060,623 | 10/1991 | McCoy | 123/605 |

OTHER PUBLICATIONS

"Electronic Ignition System for Caterpillar Natural Gas Engines", Steven R. McCoy, et al.

"Transformers for Electronic Circuits", 2d Ed., Nathan R. Grossner, pp. 332–333, McGraw-Hill Book Company, 1983.

*Primary Examiner*—Leo P. Picard
*Assistant Examiner*—L. Thomas
*Attorney, Agent, or Firm*—Woodward, Emhardt, Naughton, Moriarty & McNett

[57] ABSTRACT

An ignition coil is disclosed that includes a primary coil, a secondary coil and a core about which the primary and secondary coil are disposed. The secondary coil has in inner diameter greater than the diameter of the primary coil. The primary coil is disposed on the core and the secondary coil is disposed about the primary coil. The secondary coil includes a spiral-back pyramid winding configuration which results in a desired distributed capacitance for the secondary windings thereby providing desired electrical characteristics for a resonant circuit. The winding layers of the secondary coil decrease in the number of turns as the coil is wound to achieve a desired distributed capacitance of the coil. A spiral-back winding technique decreases adjacent winding layer voltages so that the inter-layer insulation requirements are reduced to a lower value thereby decreasing the insulation thickness of the secondary coil.

16 Claims, 16 Drawing Sheets

NOTE: SPIRAL BACK 1 3/4 TURNS IN FOLLOWING LAYER = 154 TURNS, 29,528 TOTAL TURNS

Stacked Coil Design

Total Turns: 29361 + 205.8 Spricl Back Turns = 29566.8

NOTE: SPIRAL BACK 1 3/4 TURNS IN FOLLOWING LAYER = 154 TURNS, 29,528 TOTAL TURNS

Stacked Coil Design

Total Turns: 29361 + 205.8 Sprial Back Turns = 29566.8

DC PRIMARY CURRENT WITH NO SECONDARY COIL

NON-RESONANT PRIMARY DRIVE CURRENT

NON-RESONANT SECONDARY OUTPUT VOLTAGE

RESONANCE DRIVE PRIMARY CURRENT

SECONDARY OUTPUT VOLTAGE AT RESONANCE

IGNITION COIL WITH SPIRAL-BACK PYRAMID WINDINGS

FIELD OF THE INVENTION

This invention relates to transformers and more specifically to step-up transformers used with internal combustion engine ignition systems.

BACK GROUND OF THE INVENTION

Prior art ignition coils, such as the coil shown in U.S. Pat. No. 4,677,960, and in FIG. 1, use segmented coil bobbin winding techniques to create a highly efficient, low turns ratio, low distributed capacitance secondary coil. The '960 ignition coil is activated using a pulsed ignition driving circuit. While it is true that devices known in the prior art may be used to produce very efficient ignition coils, electrical breakdown between coil windings and adjacent coil segments is a continuing failure mode. Typically such insulation breakdown problems require the use of expensive potting compounds, additional manufacturing processes and potting equipment to reduce or eliminate such electrical breakdown problem.

One of the main application requirements of a new ignition coil concept is a continuously operating twenty year life cycle (172,800 hours). Standard automotive industry style plastic segmented bobbin ignition coils and standard conventional secondary coil winding techniques that are designed to last 10,000 to 30,000 hours of intermittent operation will not satisfy such a demanding continuous life expectancy.

Spiral-back windings, also known in the art as "fly-back windings" and "Z winding traverse", are used in a variety of electronic circuits. However, use of such windings in ignition coils has not heretofore occurred.

What is needed is an ignition coil that will generate the highest output voltage possible for a specific turns ratio, supply sufficient spark gap current, exhibit good over-all operating efficiency, and have a minimum life expectancy of 172,800 hours.

SUMMARY OF THE INVENTION

An ignition coil, according to one aspect of the present invention, comprises a housing, a core including a plurality of laminations, said core disposed within the housing, a primary coil disposed about a portion of the core, and a secondary coil disposed about the primary coil, wherein the secondary coil includes a plurality of overlapping winding layers and wherein the overlapping winding layers are wound in a spiral-back pyramid configuration so that certain ones of the overlapping layer of larger diameter.

One object of the present invention is to provide an improved ignition coil.

Another object of the present invention is to provide an ignition coil with an extended life expectancy.

Yet another object of the present invention is to produce a coil using minimum insulation material that is resistant to electrical breakdown.

Still another object of the present invention is to minimize inter-layer distributed capacitance between the winding layers of the ignition coil.

A further object of the present invention is to provide an ignition coil with evenly dispersed secondary coil distributed capacity to enhance the creation of maximum ferro-resonant generated output voltage and current signals.

These and other objects of the present invention will become more apparent from the following description of the preferred embodiment.

Figure 10:
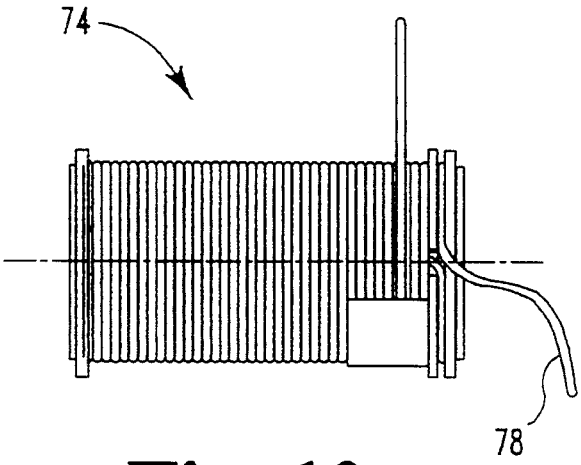
FIG. 10 is a is a front elevational view of a primary coil used in the ignition coil of FIG. 6.
Figure 12:
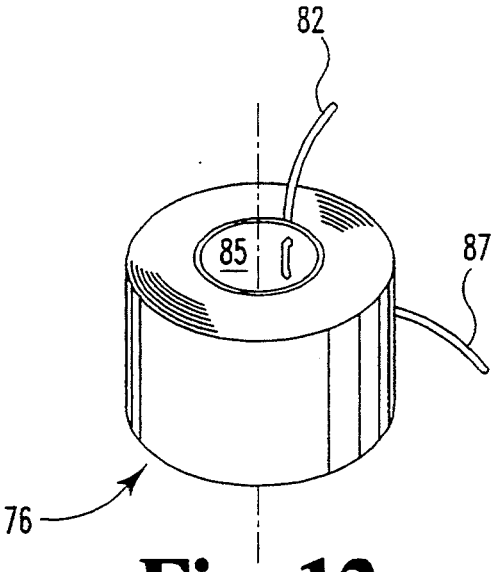
FIG. 12 is an isometric view of the spiral-back pyramid wound secondary coil shown in FIG. 9.
Figure 13A:
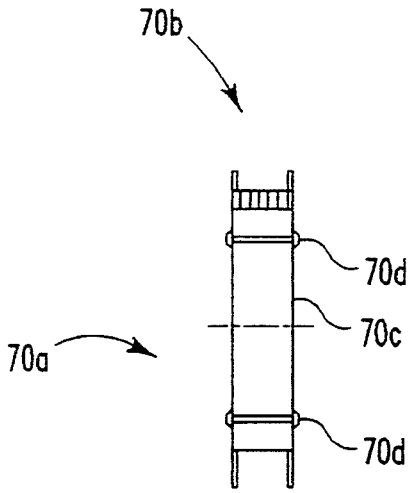
FIG. 13A is a side elevational view of core assembly of the ignition coil of FIG. 6.

FIG. l4 is an exploded view of the coil assembly including the core of FIG. 13A, the primary coil of FIG. 10 and the secondary coil of FIG. 12.

Figure 15:
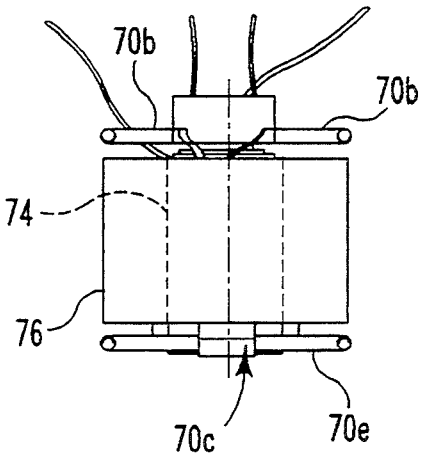

FIG. 15 is a front elevational view of the complete ignition coil assembly depicting the primary, and secondary coils installed on the core assembly.

Figure 16:
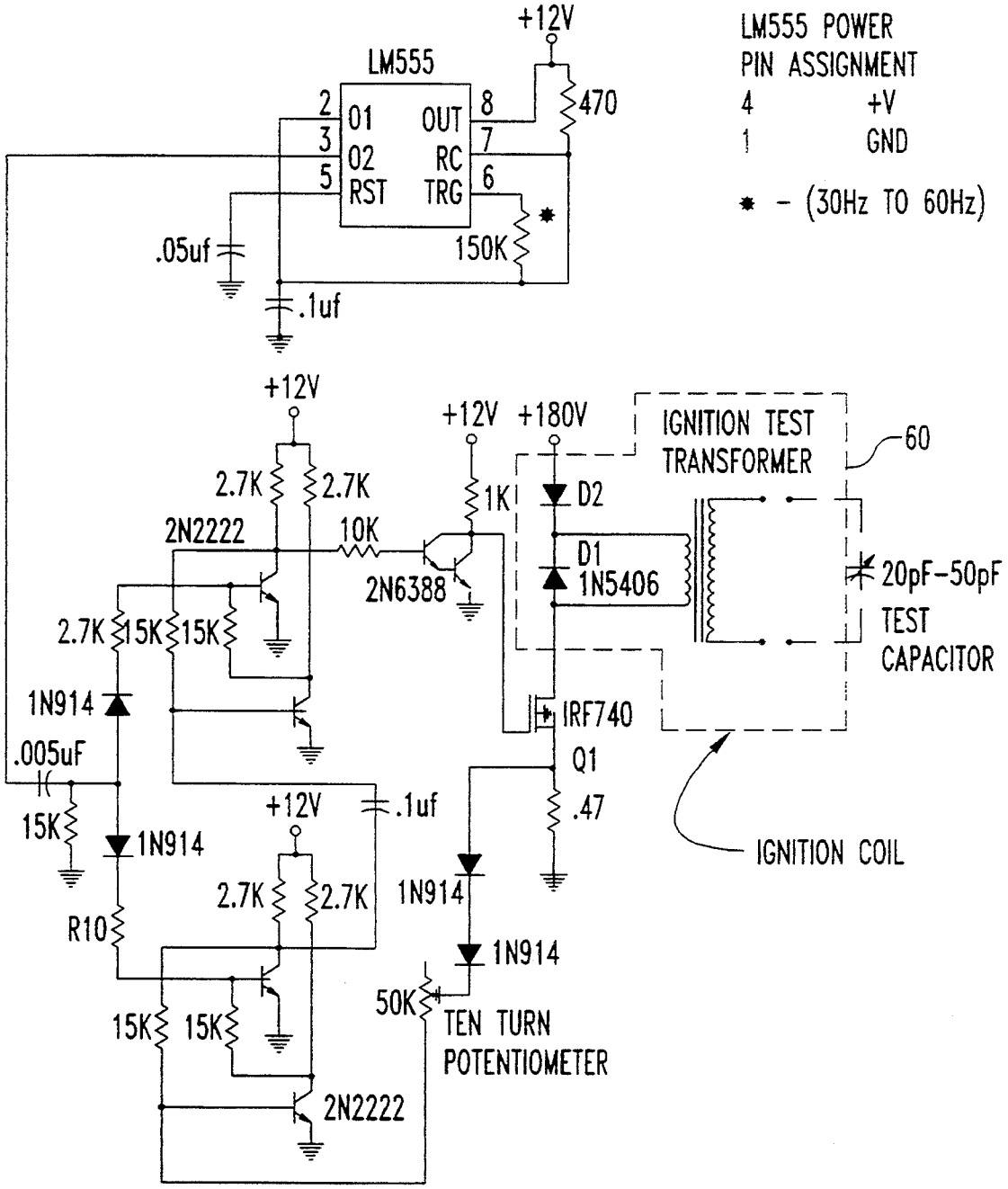

FIG. 16 is a schematic of a test circuit that produces an excitation signal for the ignition coil according to the present invention.

Figure 17:
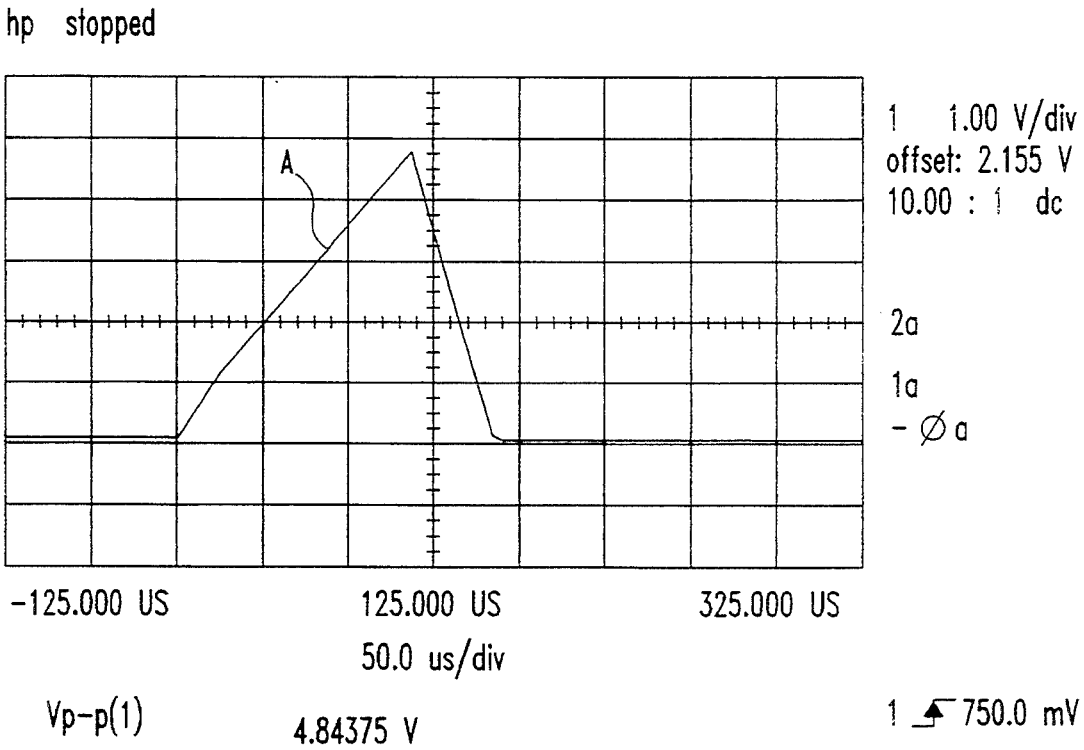

FIG. 17 is a graph of the DC current in the primary coil 74 alone.

Figure 18:
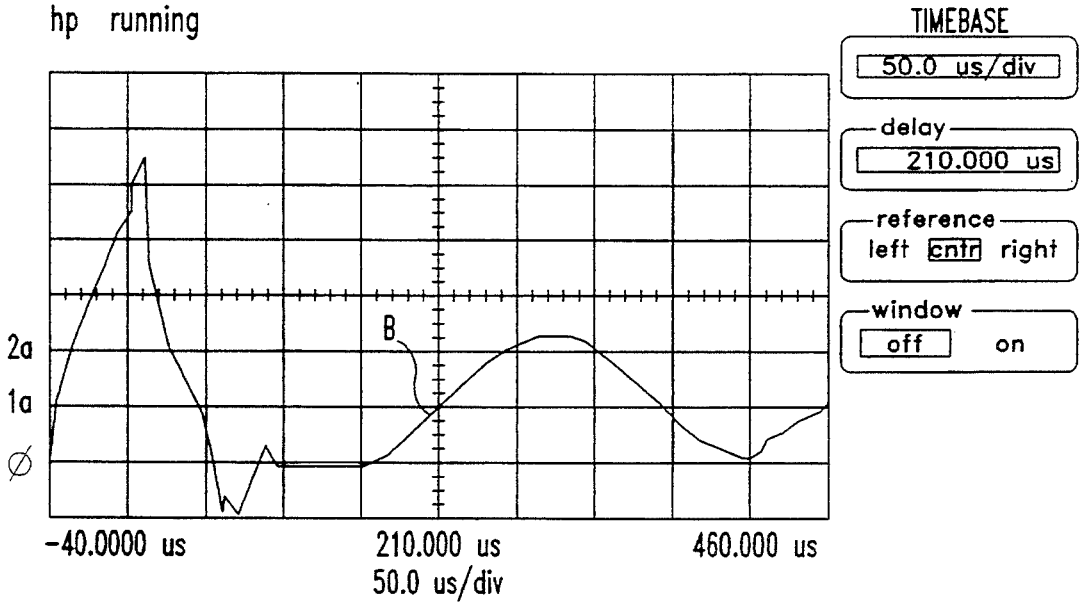

FIG. 18 is a graph of the DC current in the primary coil 74 with a secondary coil 76 disposed in relation to the primary coil as disclosed.

Figure 19:
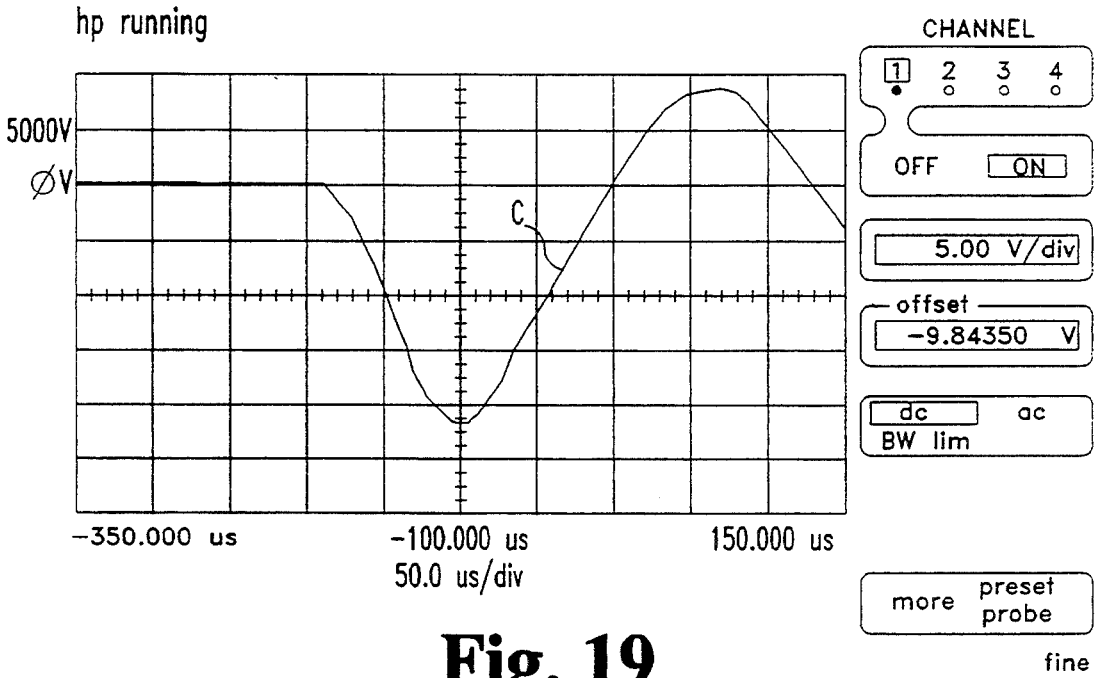

FIG. 19 is a graph of the secondary coil output voltage with a 90 pF load capacitor across the leads of the secondary coil.

Figure 20:
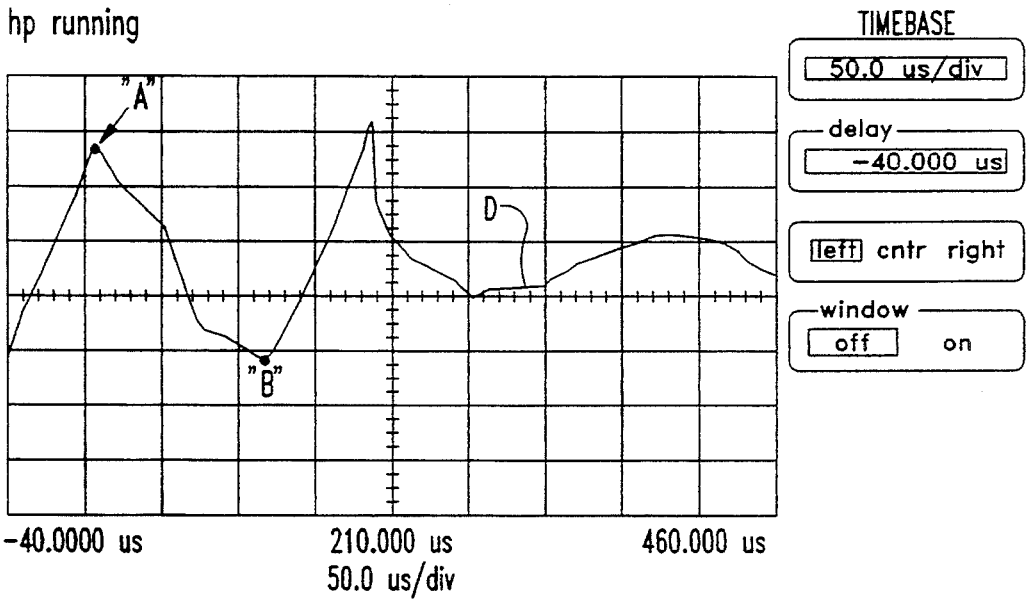

FIG. 20 is a graph of the primary coil current under no-load conditions.

Figure 21:
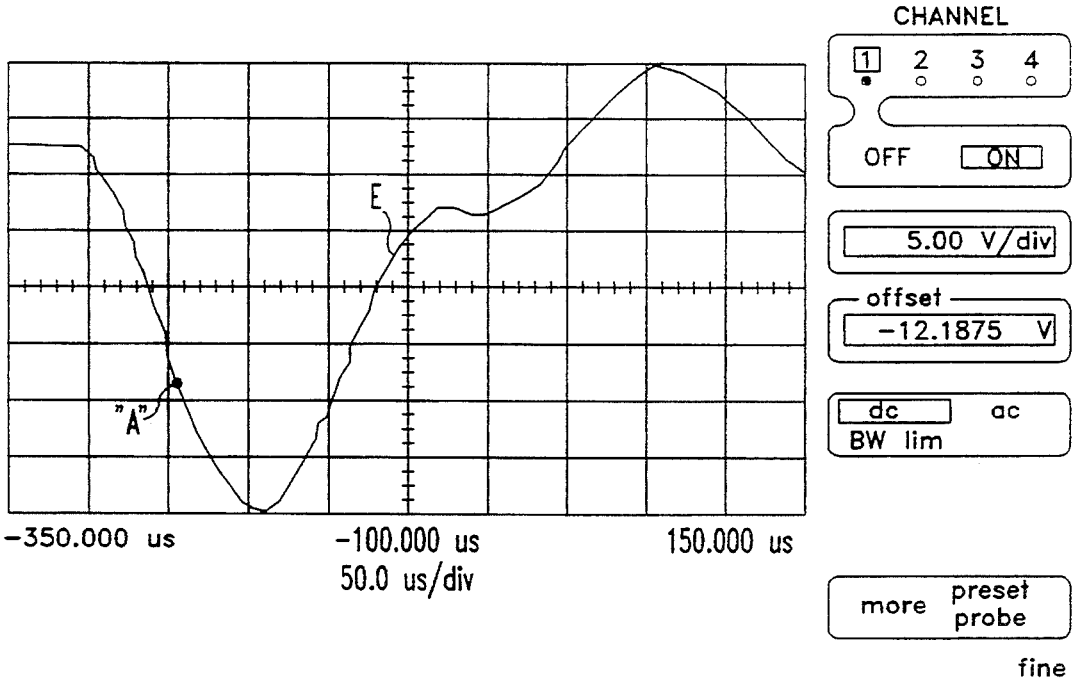

FIG. 21 of the secondary coil output voltage at resonance.

Figure 22:
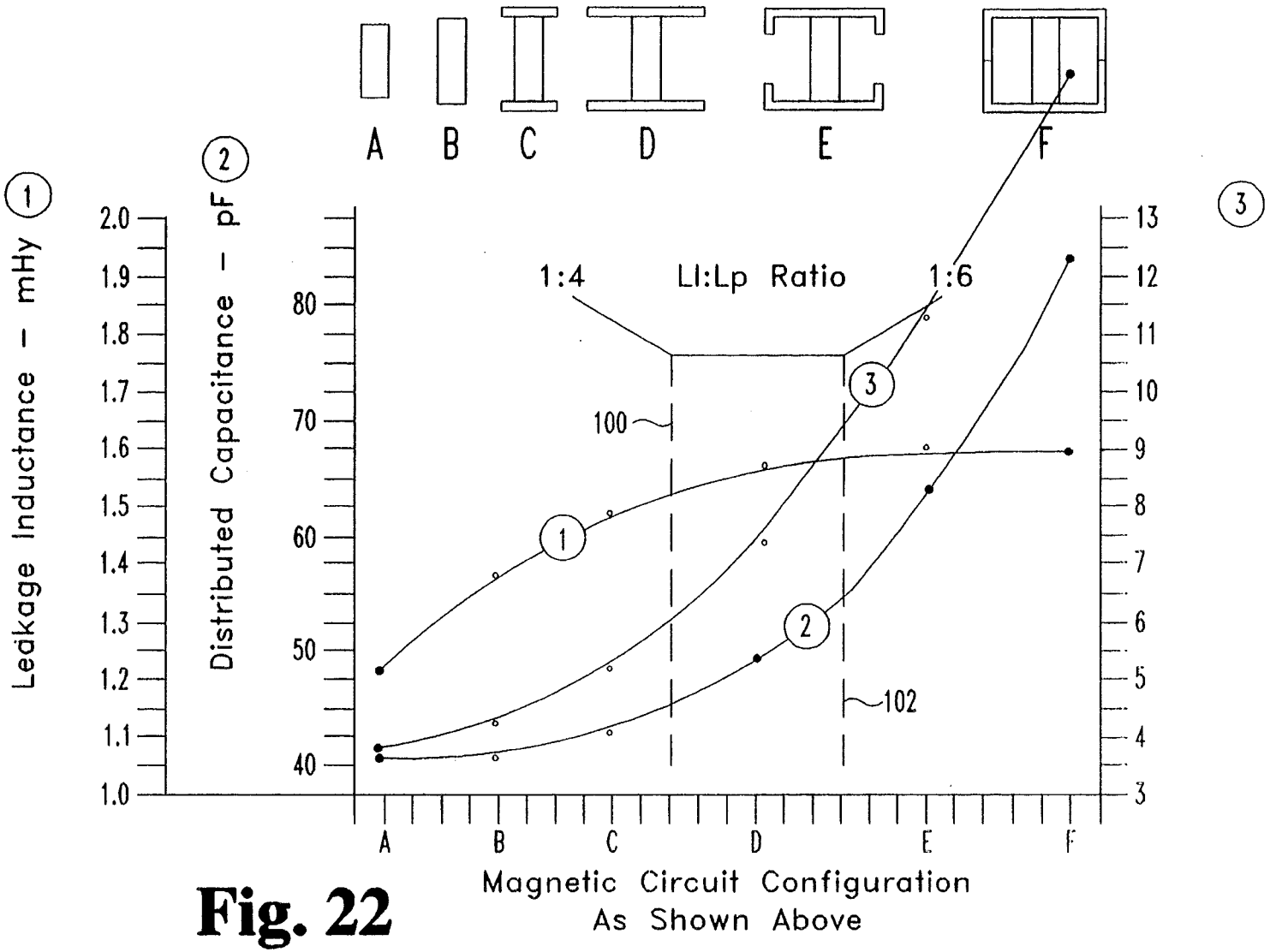

FIG. 22 is a graph depicting three curves defining L1, Lp and Cd for various core configurations shown in FIGS. 23A–23F.

Figures 23A, 23B, 23C, 23D, 23E, 23F:
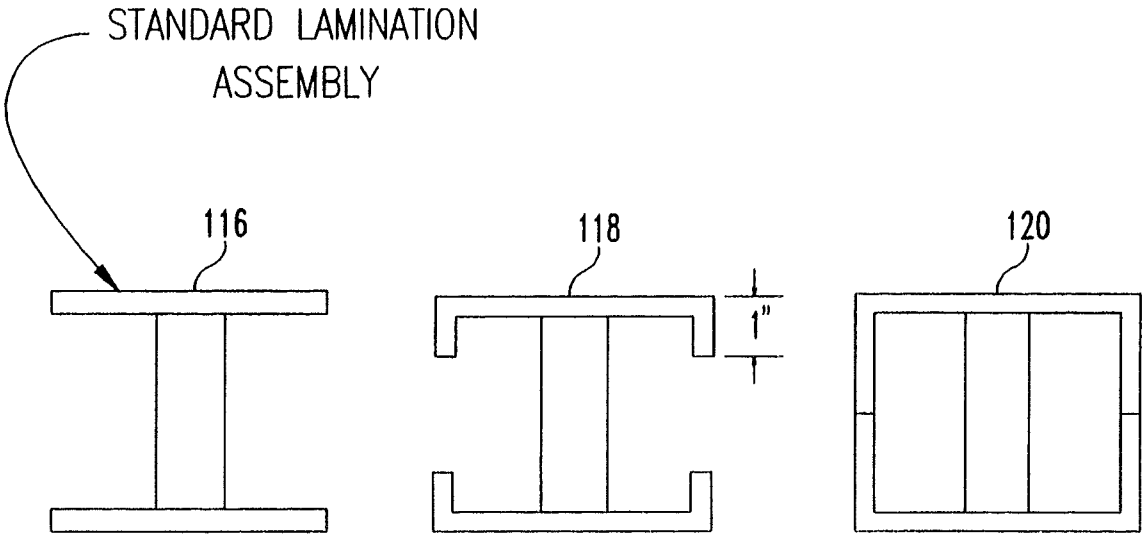

FIG. 23A is cross-section of a core configuration.

FIG. 23B is a cross-section of another core configuration.

FIG. 23C cross-section of another core configuration.

FIG. 23D is a cross-section of the core configuration of the preferred embodiment.

FIG. 23E cross-section of another core configuration.

FIG. 23F is a cross-section of another core configuration.

Figure 24:
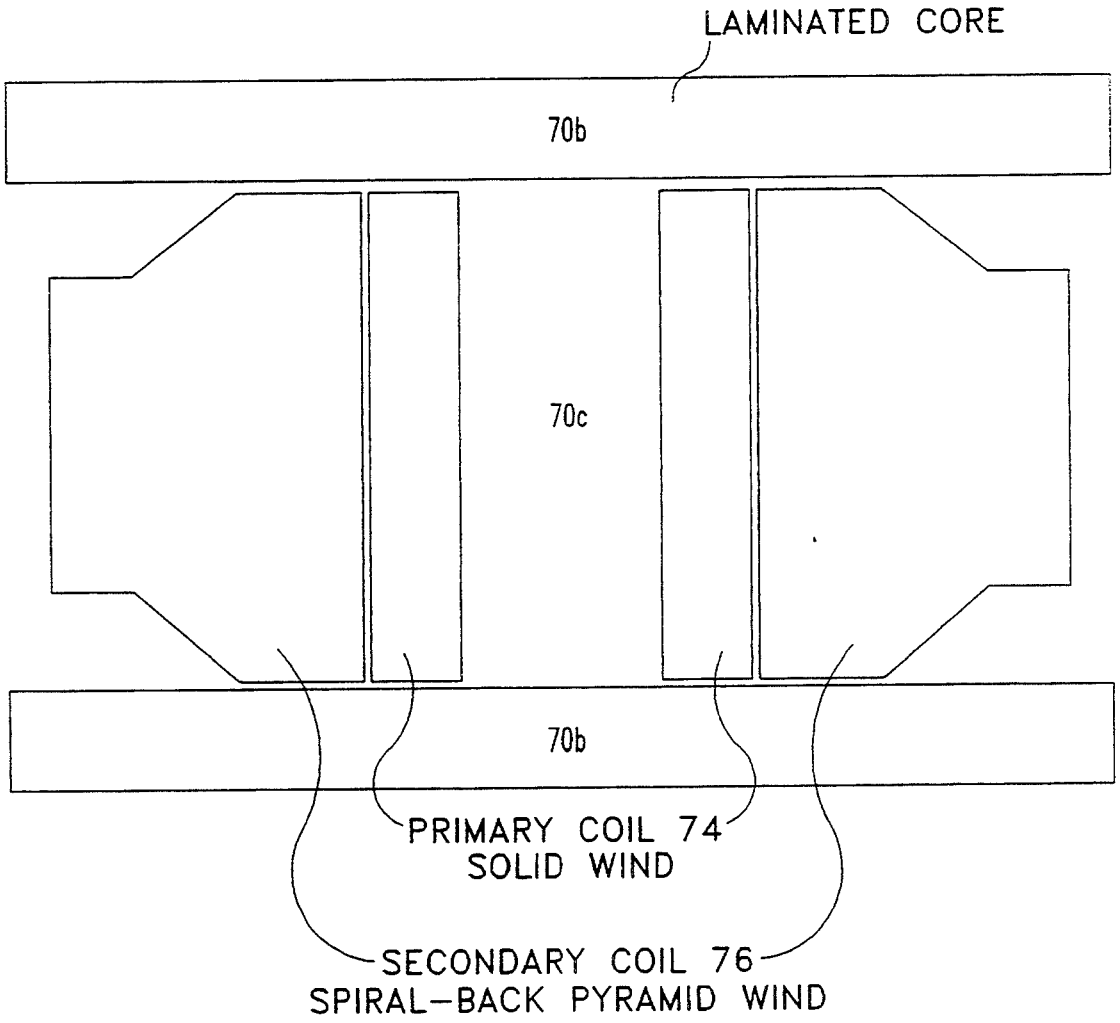

FIG. 24 is a schematic view of a laminated core with a solid wind primary coil and a spiral-back pyramid wind secondary coil mounted thereon, in accordance with the present invention.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
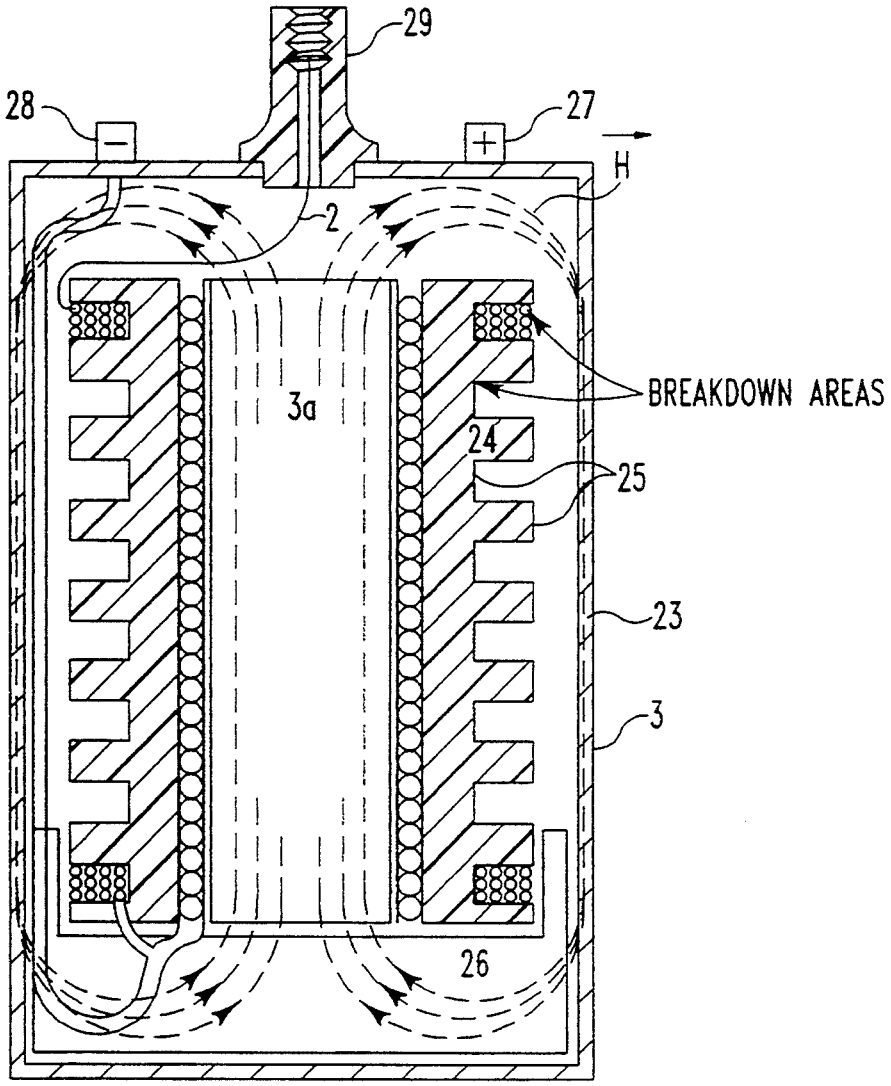
Fig. 1 (Prior Art)
FIG. 1 a cross-sectional view of a prior art coil.
Figure 2:
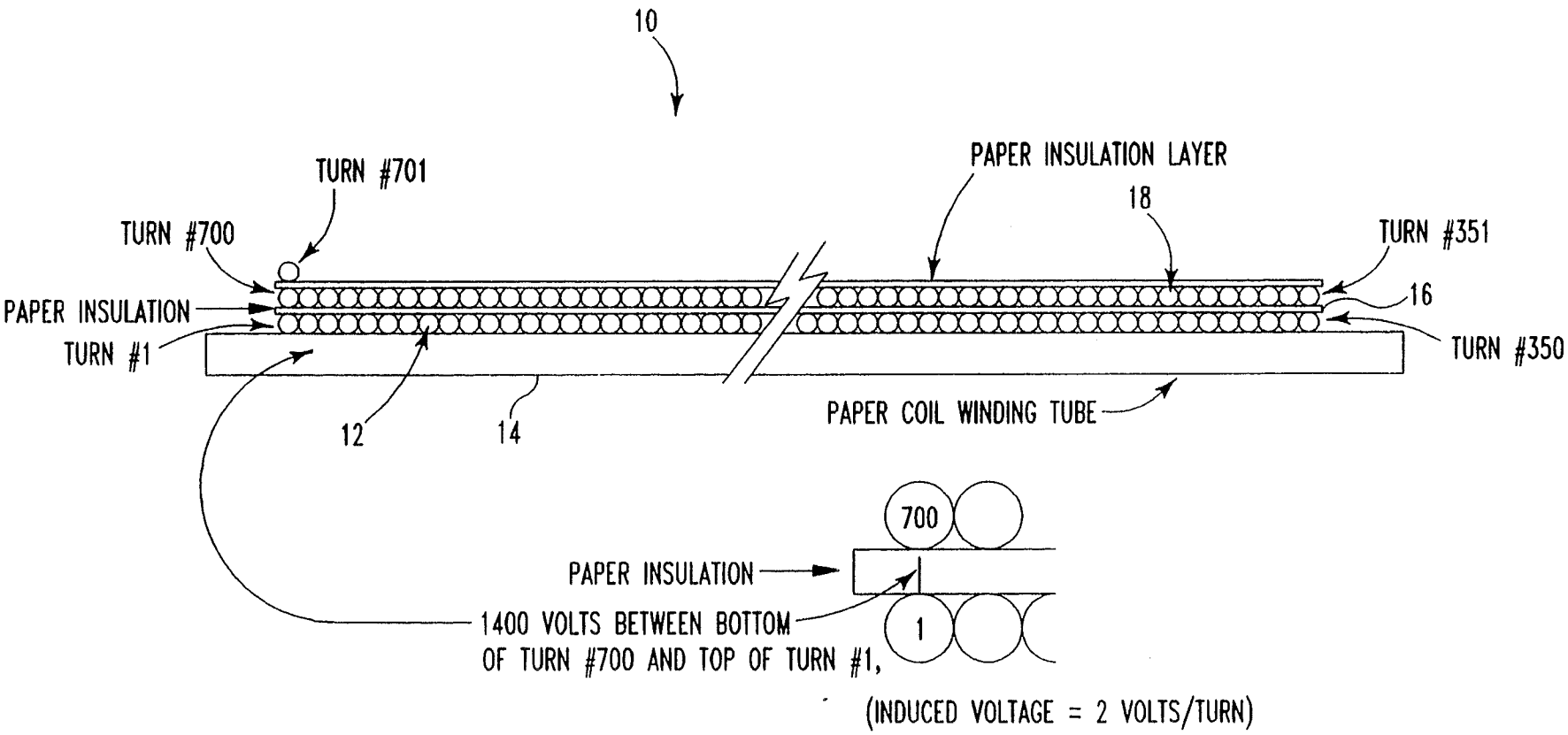
Fig. 2 (Prior Art)
FIG. 2 is a diagrammatic illustration of the coil of FIG. 1 depicting a cross-sectional view of the first two layers of a standard conventional secondary coil winding.

A well known conventional paper insulated coil winding technique is shown in FIG. 2. The standard paper insulated coil 10 is built by simply winding the first layer of wire 12 on a paper winding tube 14. After the required number of turns have been wound, a layer of insulating paper 16 is wrapped around the coil of wire 12, and a second winding layer 18 is wound back the opposite direction. This process is repeated until the required number of turns of wire is wound on the coil.

Two basic electrical characteristics are associated with the winding technique of FIG. 2. The first is that the basic insulation level requirement between winding layers is a function of the induced volts-per-turn multiplied by the number of turns of wire per layer and then doubled. This is shown in FIG. 2 where 350 turns of wire are wound on layer 12. If there is an induced voltage of two volts-per-turn, the layer of wire will development 700 volts. Since all layers of wire are structured in an additive fashion, 700 volts will be induced in layer 18. This means at the point where layer 12 starts (turn number one), and layer 18 ends (turn number 700), a minimum insulation requirement of 1400 volts will be required. The second fact has to do with the distributed capacitance of the secondary coil. The distributed capacitance inside the secondary coil cannot be treated as a single lumped capacitance parameter when analyzing the associated EMF generation function and losses for this type of coil design. The distributed capacitance of the secondary coil must be analyzed using the specific values of capacitance that exists between each individual layer of the secondary coil. Each of the individual inter-layer capacitance values is a function of the specific area of space between the associated winding layers and the dielectric of the material that occupies that area of space between the layers. The distance between all winding layers is the same, and the dielectric material between layers is the same throughout the coil, the distributed capacitance between each individual layer is primarily affected by the increased surface area between each winding layer as the winding layer radius increases in the outer layers. The direct ratio relationship of increased coil winding radius and the respective increase in inter-layer capacitance causes an increase in the distributed capacitance values in the outer layers of a conventional or standard secondary coil with respect to the distributed capacitance values that exist between the inner-winding layers.

The fact that the inner layers of a standard secondary coil have a smaller distributed capacitance than the outer coil layers causes circulating AC currents to flow between the coil layers as the induced secondary coil voltage increases. These circulating currents cause an increased loading effect on the magnetic flux lines that generate the induced EMF, which causes a lower EMF to be generated for a given change in magnetic flux density. Additionally, the circulating AC capacitive currents inside the secondary coil can cause an internal heat build-up inside the coil, and adversely affect reflected secondary impedance values. Thus, one of the objectives of the present invention is to design a coil winding method to establish the same distributed capacitance value between all coil winding layers. One approach is to equalize the distributed capacitance between layers in a secondary coil (which consists of many thousand of turns of wife) by winding fewer turns of wire per layer as the coil becomes larger in diameter. This means that the number of turns per layer must be varied to control and maintain constant the distributed capacity between each layer of wire in the secondary coil.

Figure 3:
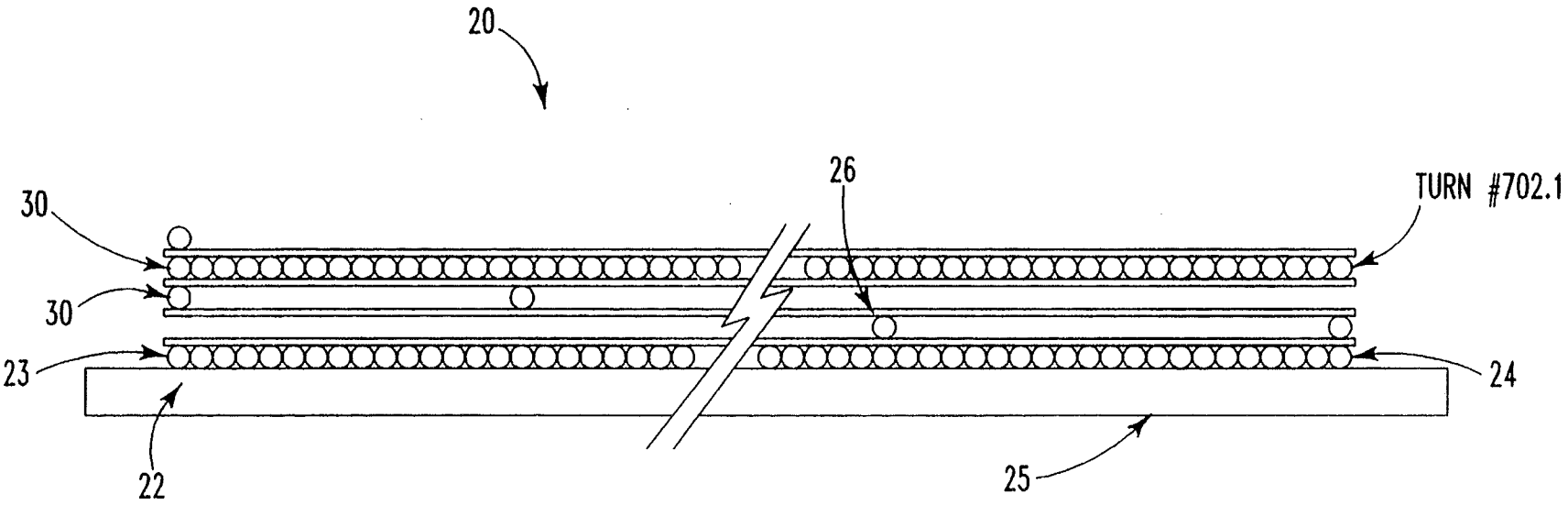
FIG. 3 is a diagrammatic illustration of a coil according to the present invention showing two winding layers and a spiral-back winding.

Referring now to FIG. 3, a spiral-back secondary winding or secondary coil 20 according to the present invention is shown. Note that FIGS. 3 and 3A appear as planar embodiments of a coil winding to facilitate illustration of the concepts of the present invention, and that the actual coils are wound on cylindrical bobbins. The first winding or layer 22 of the coil is located adjacent the coil winding tube or bobbin 25. Turn #1 of the first layer is identified at 23. In the preferred embodiment, 350 turns are included in the first layer of windings, and turn No. 350 is identified at 24. Approximately 1.7 to 2.1 layers of paper insulation 26 are wrapped about the first layer 24 as a spiral-back winding 28 is wound thereon. The next layer of windings begins with the #352.1 winding identified at 30. The insulation requirement between turn #1(indicated at 23) and turn #352.1 (indicated at 30) is 700 volts, which is one-half the inter-layer insulation requirement of the standard coil shown in FIG. 2. Additionally, a spiral-back wound coil has a lower level of distributed capacitance than the coil of FIG. 2.

Figure 4:
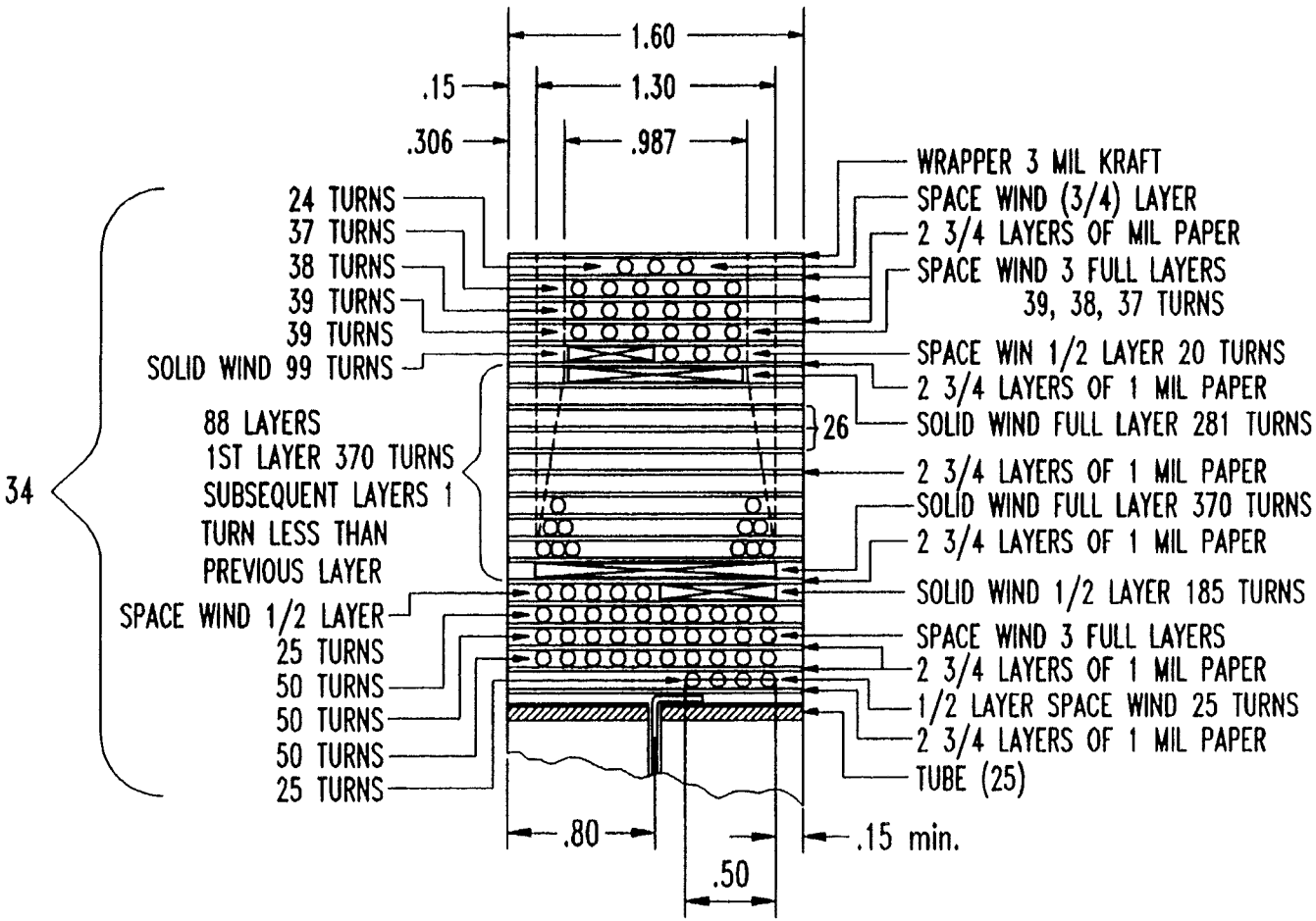
FIG. 4 is a partial cross-sectional view of a spiral-back pyramid wound secondary coil winding according to the present invention.

Referring now to FIG. 4, a partial cross-sectional view of a spiral-back secondary coil wound according to the present invention and including multiple layers is shown. Numerous winding layers 34 are wound about tube or bobbin 25. Each layer includes a predetermined number of turns according to the data of Table 1:

TABLE 1

| Layer | Number Of Turns |
|---|---|
| 1 | 25 spaced wind |
| 2 | 50 spaced wind |
| 3 | 50 spaced wind |
| 4 | 50 spaced wind |
| 5 | 25 spaced wind |
| 5 | 185 solid wind |
| 6 | 370 solid wind |
| 7–95 | 370 solid wind decreasing one turn each layer |
| 96 | 99 solid wind |
| 96 | 20 spaced wind |
| 97 | 39 spaced wind |
| 98 | 38 spaced wind |

TABLE 1-continued

| Layer | Number Of Turns |
|---|---|
| 99 | 37 spaced wind |
| 100 | 24 spaced wind |

Each winding layer is separated from the next with paper insulation indicated at 26. Layers 5 and 96 include both solid wind and spaced wind windings. Solid wind windings are overlapped wire spaced closely and/or overlapping. Spaced wind windings include some discernible spaced between each turn of the winding. Spaced and solid wind windings are terms well known in the art and no further explanation is necessary here. Computer winding machines, well known in the art, are programmable to wind the coil so that turn number one of layer two is located at a point in between turn number one and turn number two of the layer immediately below. Precision winding of this nature will nest all winding turns between the turns of the layer below and generate a smaller diameter coil.

Figure 5:
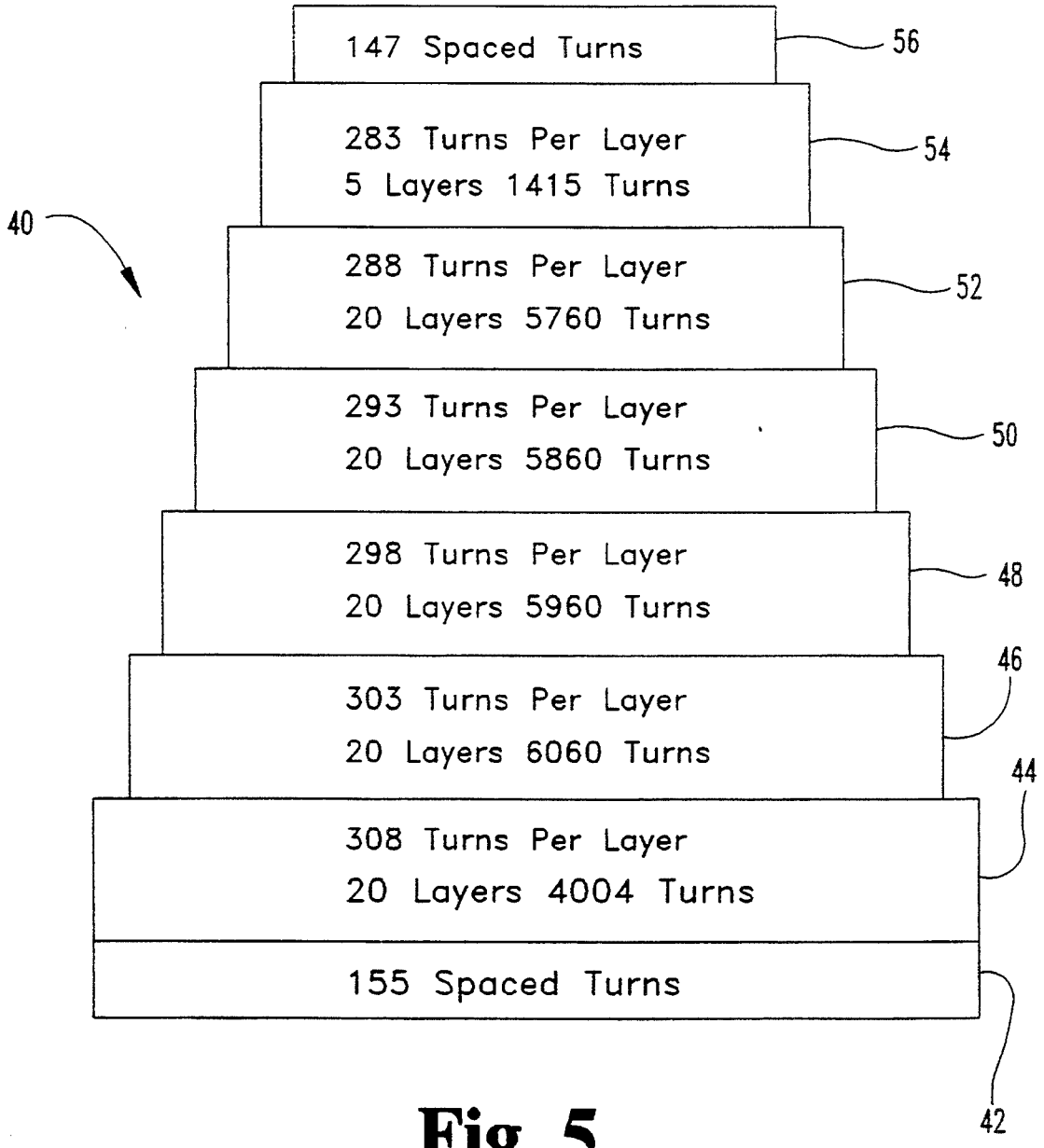
FIG. 5 is a diagrammatic illustration of another spiral-back pyramid wound secondary coil according to the present invention.

Referring now to FIG. 5, an alternate embodiment of a spiral-back secondary coil 40 according to the present invention is diagrammatically illustrated. Coil 40 includes a stacked segment arrangement, specifically six stacking segments are shown. Spiral-back windings of 1.7, 1.9 and 2.1 turns between layers may be used. The first section 42 of coil 40 includes 155 spaced wind turns. The second section 44 includes 13 winding layers each having 308 solid wind turns for a total of 4004 turns. The next section 46 includes 20 winding layers each having 303 solid wind turns for a total of 6060 turns. The next section 48 of the coil 40 has 20 winding layers each having 298 solid wind turns for a total of 5960 turns. Section 50 includes 20 winding layers of solid wind each having 293 turns. Section 52 includes 20 layers of solid wind each having 288 turns. Section 54 has 5 layers of solid wind turns each including 283 turns. Section 56 has 147 spaced wind turns. Between each layer of windings, paper insulation (not shown) and spiral-back windings (not shown) are situated therein. The coil of FIG. 5 includes 29361 coil turns and 205.8 spiral back turns for a total of 29566.8 turns. The distributed capacitance between layers of the coil 40 are not exactly equal, but the values are close enough and the coil still performs up to expectations. The coil 40 can be wound using non-computer controlled coil winding equipment known in the art.

Using a spiral-back winding technique, a maximum generated EMF (electromotive force) for a given change in magnetic flux density will be achieved since the total secondary coil distributed capacitance will be lower then coils of the prior art. Inter-layer distributed capacitances are made equal, and dielectric stresses throughout the secondary coil are minimized.

The resonant function of this ignition coil is responsible for generating the output voltage that is higher than that portion which is developed by the direct primary-secondary turns ratio. The characteristics of this ignition coil that permits the resonant function to take place can be traced directly to the unique combination of the secondary coil winding technique, the electronic driving circuit, the ignition coil lamination design, and the epoxy potting compound used to make this ignition coil.

Figure 6:
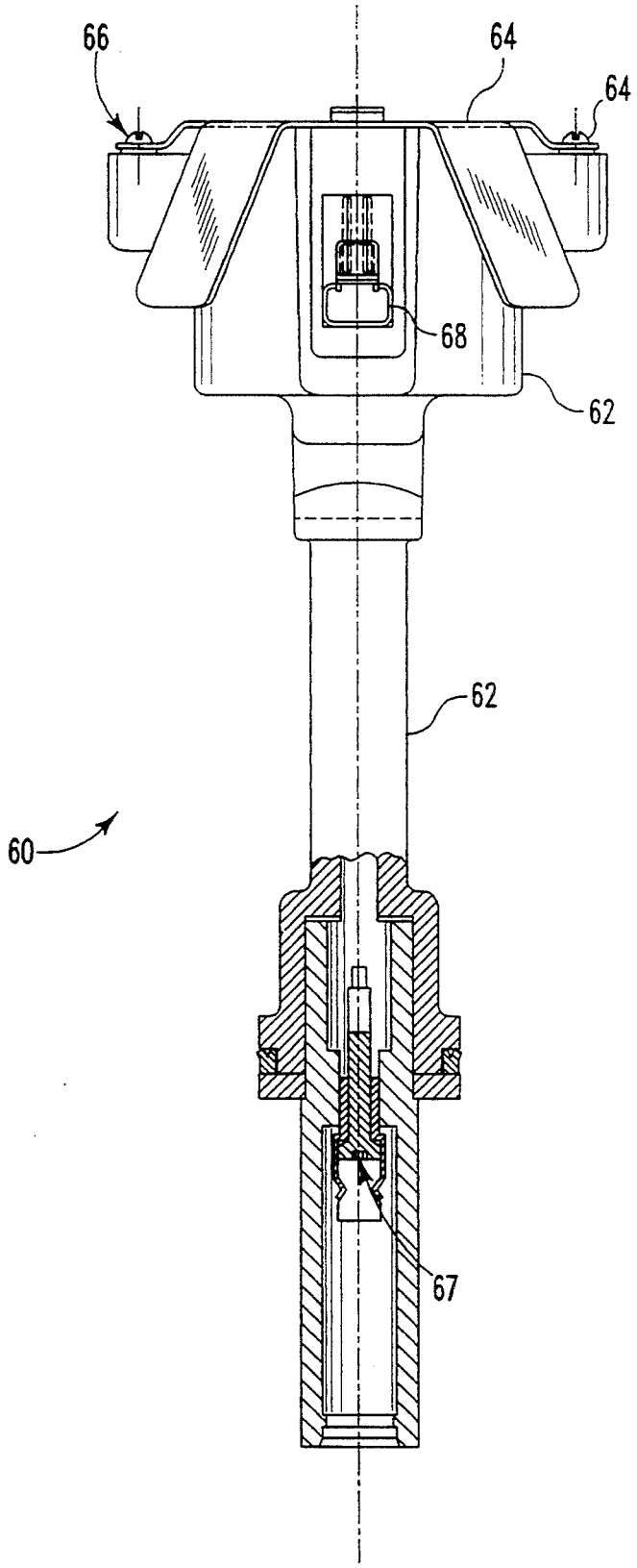
FIG. 6 is a front elevational view of an ignition coil according to the present invention.
Figure 7:
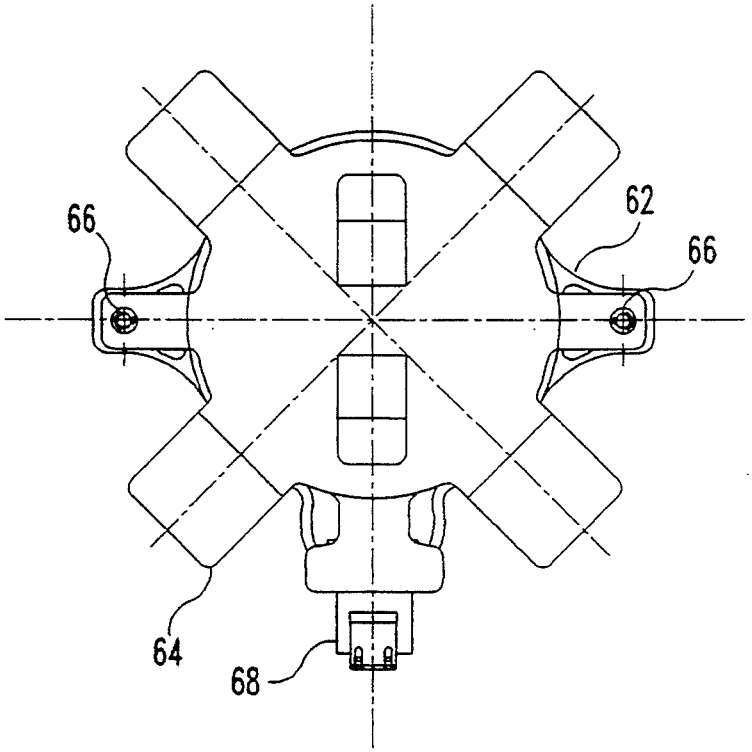
FIG. 7 is a plan view of the coil of FIG. 6.
Figure 8:
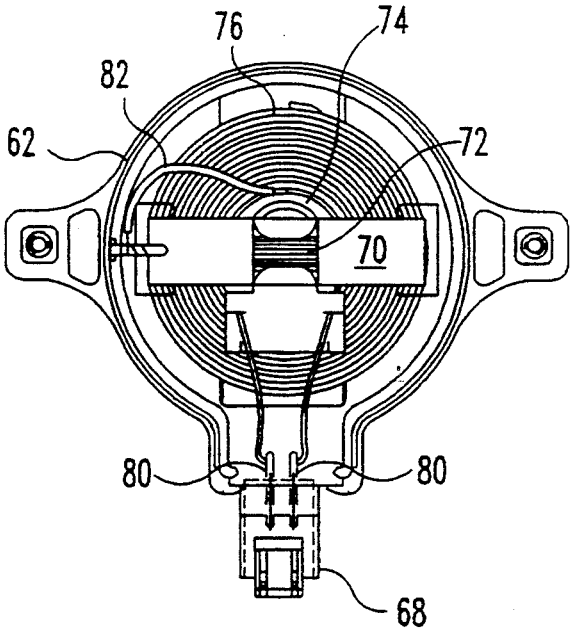
FIG. 8 is a plan view of the ignition coil of FIG. 6 with the cover removed.

Referring now to FIGS. 6 and 7, an ignition coil assembly 60 according to the present invention is shown. FIG. 6 is a partial cutaway view of the coil assembly 60 and depicts some of the internal components. FIG. 7 is a plan view of the coil assembly 60. The coil assembly 60 includes a housing 62 and a cover 64 that is secured to the housing 62 with screws 66. Within the housing 62 is a primary winding and a secondary winding both of which are mechanically attached to a core assembly (the coil/core assembly is shown in FIGS. 8 and 15). Spark plug connector 67 mechanically and electrically connects to a spark plug of an internal combustion engine (not shown). A two conductor connector 68 receives a mating connector (not shown) from a control circuit. The control circuit produces an excitation signal for the primary coil (shown in FIG. 10). A control circuit for producing an appropriate excitation signal is shown in FIG. 16.

FIG. 8 is a plan view of the coil assembly 60 with top cover 64 removed. Transformer core 70 is comprised of stamped metal laminations 72. The primary coil 74 and secondary spiral-back pyramid wound coil 76 (which is of the configuration of coil 10 or coil 40) are shown as assembled together and attached to the core 70 and disposed within housing 62. The primary coil leads 78 are connected to the terminals 80 of connector 68. Lead 82 from the secondary coil is connected to the core 70. The second lead (not shown) from the secondary coil is connected to the spark plug connector 67.

Figure 11:
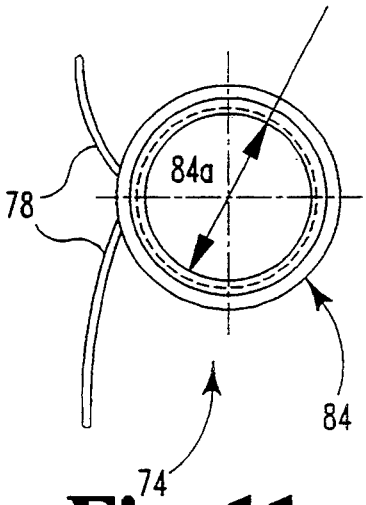
FIG. 11 is a side elevational view of the coil of FIG. 10.

Referring now to FIGS. 10 and 11, a primary coil assembly 74 according to the present invention is shown. Coil 74 is wound about a bobbin 84. Bobbin 84 includes a hollow interior **84*a*. The bobbin 84 is hollow so that the core 70** can be inserted therein.

Figure 9:
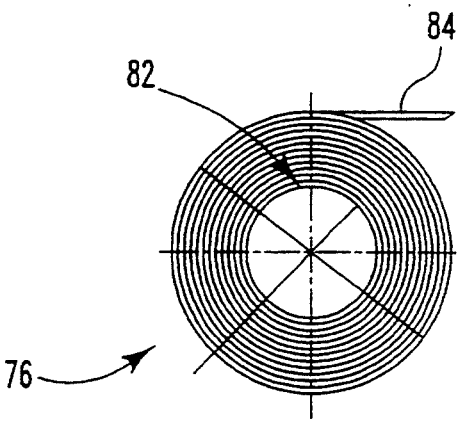
FIG. 9 is a view of a secondary coil used in the ignition coil of FIG. 6.

Referring now to FIGS. 9 and 12, a plan view and an isometric view of a spiral-back pyramid wound secondary coil 76 according to the present invention is shown. Lead 82 is shown extending from the upper side of coil 76 so that connection of lead 82 to core 70 is facilitated. Lead 84 is connected to spark plug connector 67 of FIG. 6. The coil is formed about bobbin 85. Bobbin 85 has an internal diameter sized to receive the outer diameter dimension of coil 74.

Figure 13B:
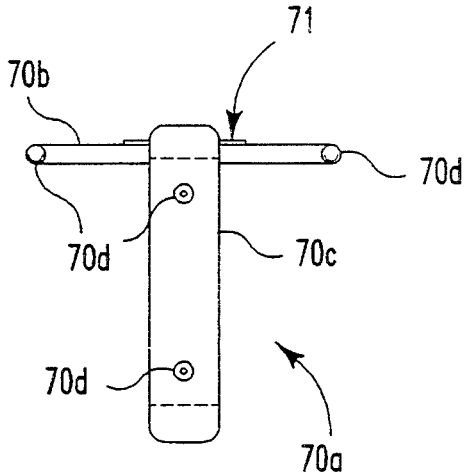
FIG. 13B is a front elevational view of the core assembly of FIG. 13A.
Figure 14:
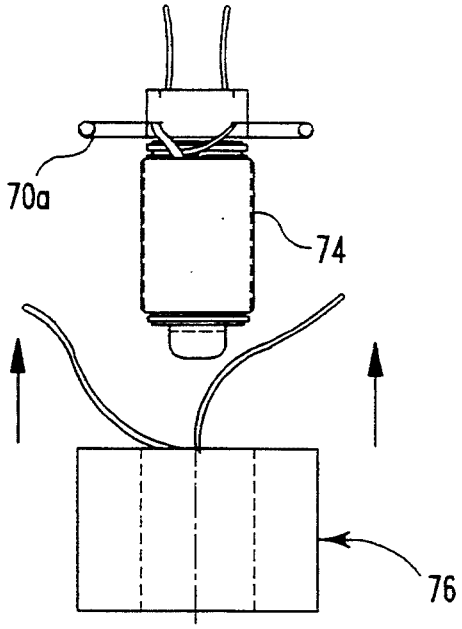

Referring now to FIGS. 13A, 13B, 14 and 15, the technique for assembly of the coils (74 and 76) to core 70 is shown. FIG. 13A is a side elevational view of a portion **70*a* of the core 70. FIG. 13B is a front elevational view of the core portion shown in FIG. 13A. Laminations 70*b* and 70*c* are attached using rivets 70*d* in a manner well known in the art of transformer manufacturing. A retainer plate 71 is fixedly mounted between the outer laminations of lamination 70*c* and maintains laminations 70*b* in position adjacent and contacting laminations 70*c*. The steps for assembly of the coil/core assembly will now be described. First, primary coil 74 is disposed over laminations 70*c*. Note that primary coil 74 is shown with an insulative material attached to the periphery of the coil to prevent electrical contact with the inner diameter portions of the secondary coil 76. Coil 76 is next disposed over the primary coil 74. Then laminations 70e are attached to laminations 70*c* by bending the outer laminations of laminations 70*c*** using a sheet metal bending/clamp technique well known in the art.

Referring now to FIG. 16, a schematic for an electronic test circuit used for design development and testing of the ignition coil assembly 60 is shown. The schematic of the actual ignition coil assembly 60 is shown inside the broken line area of this figure. Two diodes D1 and D2 are used in the ignition coil and located in the ignition coil housing 62. D1 is used as a damping diode that rectifies the secondary output voltage and spark plug spark current to be a single polarity. D2 is used as an isolation diode. The ignition coil high voltage is developed only while Q1, the IRF740 transistor, is turned "on". When Q1 is turned "on", DC current flows through the primary side of the ignition coil 60. The DC primary current rises very fast, but the rate at which the current rises is limited by the inductance of the primary coil and the internal impedance of the driver circuit. As the primary current is increasing, an EMF is induced in the secondary of the ignition coil during positive primary current rise. When the primary current is turned "off", the energy from the collapsing magnetic field is dampened out by Diode D1 and no secondary voltage is developed.

Normally, it is expected that the secondary voltage developed by a transformer with a primary to secondary turns ratio of 1 to 121 and a primary supply voltage of 180 volts to be about 21,780 volts. However, if an ignition coil that is constructed as according to the present invention is tested, an open circuit secondary voltage of about 33,000 volts will be generated. The 33,000 volts value is about 1.52 times higher than the transformer turns ratio would indicate. The description that follows will explain why this increased voltage generation occurs and how each of the specific ignition coil parts factors into this result.

If a primary coil without a secondary coil is connected to the test circuit of FIG. 16 and the DC current in the primary coil is monitored, a waveform A as shown in FIG. 17 is developed. The DC current is at zero amps when transistor Q1 is turned "on" and the current in the primary coil starts to increase immediately. The current goes from zero to 4.8 Amps, which is the test circuit's current limiting cut-off point, in about 136 microseconds. When the DC current is turned off, the damper diode D1 turns on, and the current immediately goes back to zero. The 136 microseconds time span is the charging time relationship that is set-up by the 180 VDC and the inductive reactance of the coil primary, which for this test example was 4.23 mH.

Nest a 29,500 turn secondary coil, which uses the spiral back winding technique, is disposed over the primary coil and a retest of the coil is begun with a 90 pF capacitor as a load on the secondary coil. A primary coil current waveform B as shown in FIG. 18 is observed. This waveform shows a primary current that increases from zero to 5.5 amps in about 50 microseconds. This is much faster than the 136 microseconds that was observed in the test of the primary coil winding alone. This rise time difference can be explained as follows. The inductance of the ignition primary coil with the secondary coil open-circuited is 4.23 mH or higher if the coil was constructed as described above. If the secondary coil leads are shorted together, the primary coil inductance will measure about 1.55±0.15 mH. The 1.55 mH is considered the ignition coil's "leakage inductance". A primary coil with an apparent dynamic inductance of 1.55 mH will have a much faster rise-time than a 4.23 mH primary coil. When a 90 pF capacitive load is placed across the secondary coil leads, the primary coil "sees" this load, as reflected through the turns ratio of 1:121, as a short circuit because the 90 pF capacitor along with the 43 pF distributed capacitance of the secondary forms a series resonant circuit with the ignition coil's leakage inductance. It is well known that at resonance (resonant frequency) the impedance of a series resonant circuit goes to zero. In addition, at the beginning of the rise in the primary coil current, the secondary distributed capacitance is in a discharged state which is also reflected as a very low impedance. These two facts set-up a very low dynamic primary ignition coil inductance and thus the resultant faster current rise-time as shown in FIG. 18. The resultant secondary output voltage with the 90 pF load capacitor is shown in the waveform C in FIG. 19. Note that the output voltage is a negative 21,150 volts which is very close to what the 1:121 turns ratio should generate.

A "no-load" test of the ignition coil will produce a primary current waveform D as shown in FIG. 20. The waveform D describes the very fast initial current rise time. But, just before the rising primary current hits the current cut-off point of the drive circuit, it reverses direction and declines to about one Ampere and then rises again until the test circuit's DC current trip point is reached. The open circuit output voltage waveform E, shown in FIG. 21, details how a negative voltage of 32,500 volts is generated which is about 1.53 times higher than that generated with the 90 pF load capacitor. The higher secondary output voltage is a direct result of the resonance function of this ignition coil coupled with the output characteristics of the driver or test circuit of FIG. 16.

The higher output voltage (higher than the standard output voltage that is developed by the primary- secondary turns ratio) is the result of energy being returned to the transformer circuit by the tank circuit action of the series resonant circuit formed by the leakage inductance and the combination of the distributed capacitance of the secondary and the load capacitance of the secondary.

The tern "tank circuit" is used to help explain how the resonant function returns energy back into the ignition coil's magnetic circuit. When an electronic resonant tank circuit receives an electrical energy pulse with the correct electrical characteristics, it will generate a sine wave signal function at its resonant frequency, which in this case is determined in accordance with the ignition coil's leakage inductance and the combination of the distributed capacitance and the load capacitance. Once the resonant circuit is shock excited into oscillation, it will continue oscillating until all of the input energy is dissipated or coupled into another circuit.

In the magnetic circuit of ignition coil 60, the energy that develops the output voltage at the indicated turns ratio is supplied by the fast rising DC primary current that flows when transistor Q1 is turned on. The increasing DC primary current generates increasing magnetic lines of flux in the ignition coil's ferrous laminations. Concurrently, the excitation signal is also exciting the resonant circuit into an oscillatory cycle. If the ignition coil is designed in such a fashion that the indicated turns-ratio output voltage is developed at about the same time that the primary current is reaching the cut-off trip point of the electronic driver circuit and the resonant circuit has completed one-half of its initial oscillatory cycle, the resonant circuit will return its acquired oscillatory energy into the ignition coil's magnetic circuit further driving the secondary output voltage higher. This can be observed as point "A" in FIG. 20 where the primary current starts decreasing, but as shown at point "A" in FIG. 21, the secondary output voltage is still increasing. The output voltage will continue to increase until the energy that is being returned to the magnetic circuit by the resonant circuit can no longer increase the magnetic flux level of the ignition coil's magnetic circuit. The secondary output voltage will be the highest at the point where algebraic addition of the primary supply current plus the returning resonant circuit energy is the highest.

It should be noted that the primary coil current reverses direction momentarily and drops down to about one Ampere. The DC current is not actually reversing, but as the resonant circuit returns its energy to the magnetic circuit, a counter EMF is developed in the primary coil which reduces the actual DC primary current from the driver circuit's power supply. After the resonant circuit has returned its maximum amount of energy to the magnetic circuit, its resonant energy starts to decline along with the generated counter-EMF in the primary winding. As the counter-EMF declines, the primary current from the driver circuit's power supply begins to increase, as shown at point "B" in FIG. 20, and continues to increase until it reaches the current cut-off point of the driver circuit.

The material used to construct laminations 70*a*, 70*c* and 70*e* is instrumental in producing the desired response from ignition coil assembly 60 and must be properly designed to generate a desired output voltage. First, the lamination material must permit the generation of the required number of magnetic lines of flux without saturating. Further, the hysteresis and eddy current losses attributable to the lamination material and physical lamination shape must be low enough at the resonant frequency of the leakage inductance and distributed capacitance to permit a sufficient resonant circuit "Q" to store and return the required tank circuit energy to the magnetic circuit for the additional resonance voltage boost to the secondary output voltage. The physical size and design of the laminations must permit the maximum magnetic coupling between the primary and secondary coils while keeping the distributed capacitance between the secondary coil and the laminations as low as possible.

The basic goal of the primary core lamination is to have enough core area so the core does not saturate at the point in time of maximum magnetic flux density. Maximum magnetic flux density occurs when the resonant tank circuit is returning its energy back into the magnetic circuit. The goal of the additional end laminations 70*b* and 70*e* is to increase the magnetic coupling to the maximum possible without adding additional distributed capacitance to the secondary coil circuit. Another aspect of this ignition coil's magnetic circuit design is the relationship between the resonant tank circuit function and the ratio of the open circuit inductance to leakage inductance. It was empirically determined that maximum secondary output voltage was developed when that ratio was between 1:4 and 1:6. For the ignition coil application, a leakage inductance of 1.5 to 1.65 milliHenrys would require an open circuit inductance of 6 to 9.5 milliHenrys. The conditions of optimum resonant circuit "Q", minimum secondary distributed capacitance, and maximum magnetic circuit coupling occur with these ratios for the coil assembly 60. This is graphically shown in FIG. 22 as the area between the two broken lines 100 and 102. The data in Table 2 was used to plot the curves 1, 2 and 3 of FIG. 22. Values for Cd (distributed capacitance), L1 (leakage inductance), and Lp (primary inductance) are plotted for each of the core cross-sectional configurations 110, 112, 114, 116, 118 and 120 of FIG. 23A–F. It can be observed that as the laminations extend around the periphery of the secondary coil, the distributed capacitance increases rapidly. If Cd is too large, it will alter the resonant function of the coil and prevent desired operation.

TABLE 2

| Core Design | Cd (pF) | L1 (mH) | Lp (mH) |
|---|---|---|---|
| 110 | 42 | 1.22 | 3.76 |
| 112 | 42 | 1.38 | 4.21 |
| 114 | 43 | 1.49 | 5.28 |
| 116 | 48 | 1.57 | 7.08 |
| 118 | 63 | 1.60 | 11.4 |
| 120 | 84 | 1.60 | 15.8 |

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An ignition coil comprising:

a substantially H-shaped core comprising a plurality of laminations, said core including two legs and a cross-member;

a primary coil disposed about said cross-member of said core; and a secondary coil disposed about said primary coil, wherein said secondary coil includes a plurality of overlapped winding layers and wherein the overlapping winding layers are wound in a spiral-back pyramid configuration.

2. The ignition coil of claim 1 wherein said secondary coil includes a first output lead and a second output lead and said ignition coil further includes a load connected to said first and second output leads, and wherein a periodic excitation signal is supplied to said primary coil thereby inducing a signal in said secondary coil.

3. The ignition coil of claim 2 wherein said secondary coil has a distributed capacitance, said load has a load capacitance and a load inductance, and wherein a series resonant circuit including said distributed capacitance, said load capacitance and said load inductance has an initial charge time that is less than the rise time of said excitation signal.

4. The ignition coil of claim 3 wherein said periodic excitation signal is a pulse excitation signal.

5. The ignition coil of claim 4 wherein a turns-ratio output voltage developed in said secondary coil is achieved at approximately the same time as the current developed in said primary coil is approaching a predetermined cut-off current amplitude.

6. The ignition coil of claim 5 wherein said predetermined cut-off current amplitude is determined in accordance with said excitation signal.

7. An ignition coil comprising:

a core comprising a plurality of laminations and having an H-shaped cross-section including two legs and a cross-member;

a primary coil wound on said cross-member of said core, said primary coil having a first primary lead and a second primary lead;

a secondary coil situated over said primary coil, said secondary coil including a first secondary lead and a second secondary lead, wherein said secondary coil includes a plurality of overlapping winding layers, and wherein the overlapping winding layers are wound in a spiral-back pyramid configuration and;

an excitation circuit that supplies a periodic excitation signal across said first primary lead and said second primary lead.

8. The ignition coil of claim 7 wherein said ignition coil further includes a load connected to said first and second secondary leads, said load having a load capacitance and a load inductance.

9. The ignition coil of claim 8 wherein said secondary coil has a distributed capacitance, wherein a series resonant circuit is realized that includes said distributed capacitance, said load capacitance and said load inductance, and wherein said series resonant circuit has an initial charge time that is less than the rise time of said excitation signal.

10. The ignition coil of claim 9 wherein said periodic excitation signal is a fast rise time pulse excitation signal.

11. The ignition coil of claim 10 wherein a turns-ratio output voltage developed in said secondary coil is achieved at approximately the same time as the current developed in said primary coil is approaching a predetermined cut-off current amplitude.

12. The ignition coil of claim 11 wherein said predetermined cut-off current amplitude is determined in accordance with said excitation signal.

13. The ignition coil of claim 8 wherein the voltage developed in the secondary coil is in excess of the voltage appearing across the primary coil multiplied times the turns ratio determined by the quantity of windings found in said primary coil and said secondary coil.

14. The ignition coil of claim 13 wherein said secondary coil has a distributed capacitance, and wherein a series resonant circuit is realized that includes said distributed capacitance, said load capacitance and said load inductance, and wherein said series resonant circuit has an initial charge time that is less than the rise time of said excitation signal.

15. The ignition coil of claim 14 wherein said overlapping winding layers of said secondary coil are insulated from adjacent overlapping winding layers by an insulator disposed therebetween.

16. The ignition coil of claim 15 wherein said insulator is a paper insulator, and wherein said primary coil is wound about a secondary bobbin and said primary coil is wound about a primary bobbin.

* * * * *